US007235109B2

(12) United States Patent
Kleker

(10) Patent No.: US 7,235,109 B2
(45) **Date of Patent: *Jun. 26, 2007**

(54) APPARATUS FOR PROCESSING GARMENTS INCLUDING A WATER AND AIR SYSTEM

(76) Inventor: Richard G. Kleker, 98 Price La., Pleasant Hills, CA (US) 94523

( * ) Notice: Subject to any disclaimer, the term of this patent is extended or adjusted under 35 U.S.C. 154(b) by 0 days.

This patent is subject to a terminal disclaimer.

(21) Appl. No.: 10/822,461

(22) Filed: Apr. 12, 2004

(65) Prior Publication Data

US 2006/0101867 A1 May 18, 2006

(51) Int. Cl.
*D06B 15/09* (2006.01)
*D06F 58/00* (2006.01)
*F26B 19/00* (2006.01)

(52) U.S. Cl. ..... 8/149.3; 68/5 B; 68/5 C; 34/487; 34/106; 34/202

(58) Field of Classification Search ..... 8/149.1, 8/149.2, 149.3; 68/5 A, 5 B, 5 C, 5 R, 20, 68/205 R, 19.2; 134/172, 174, 199, 198, 134/200; 34/106, 202, 487, 222, 229
See application file for complete search history.

(56) References Cited

U.S. PATENT DOCUMENTS

| | | | | |
|---|---|---|---|---|
| 2,741,113 | A | | 4/1956 | Norkus |
| 2,845,786 | A | | 8/1958 | Chrisman |
| 3,102,796 | A | | 9/1963 | Erickson |
| 3,114,919 | A | | 12/1963 | Kenreich |
| 3,166,923 | A | | 1/1965 | Zacks |
| 3,257,739 | A | | 6/1966 | Wentz |
| 3,664,159 | A | | 5/1972 | Mazza |
| 3,672,188 | A | | 6/1972 | Geschka et al. |
| 3,683,651 | A | | 8/1972 | Mazza |
| 3,707,855 | A | | 1/1973 | Buckley |
| 3,732,628 | A | | 5/1973 | Blevens et al. |
| 3,739,496 | A | | 6/1973 | Buckley et al. |
| 3,868,835 | A | * | 3/1975 | Todd-Reeve ..... 68/20 |
| 4,173,077 | A | * | 11/1979 | Birke et al. ..... 34/462 |
| 4,207,683 | A | | 6/1980 | Horton |
| 4,391,602 | A | | 7/1983 | Stichnoth et al. |
| 4,646,769 | A | * | 3/1987 | O'Brien et al. ..... 134/199 |

(Continued)

FOREIGN PATENT DOCUMENTS

DE 2035540 * 1/1972

OTHER PUBLICATIONS

New York Magazine, Nov. 17, 2003, 2 pages, advertisement for The Maytag Neptune Drying Center.

*Primary Examiner*—Joseph L. Perrin
(74) *Attorney, Agent, or Firm*—Ronald Rohde; C. Bart Sullivan

(57) ABSTRACT

A garment processing apparatus is disclosed. The garment processing apparatus may include a manifold having a plurality of arms. Each of the arms may be configured to discharge air. A cabinet may be configured to support a plurality of garments with each of the garments positioned between a different pair of adjacent arms. A closed loop air system may include a condenser to remove water from the air discharged from the manifold, and/or a steam generator to inject steam into the air discharged from the manifold. A chemical agent may also be injected into the air discharged from the manifold.

26 Claims, 4 Drawing Sheets

U.S. PATENT DOCUMENTS 4,761,305 A 8/1988 Ochiai
4,784,666 A 11/1988 Brenner et al.
5,092,141 A 3/1992 Quinn
5,207,764 A * 5/1993 Akabane et al. ..... 68/20
5,226,203 A 7/1993 Sacconato et al.
5,228,211 A 7/1993 Stubbing
5,305,484 A * 4/1994 Fitzpatrick et al. ..... 8/149.3
5,516,012 A 5/1996 Weigel
5,730,006 A 3/1998 Conley
5,784,905 A 7/1998 Townsend et al.
5,815,961 A 10/1998 Estes et al.
5,836,486 A 11/1998 Ohsugi
5,887,454 A 3/1999 Renzacci
5,887,456 A * 3/1999 Tanigawa et al. ..... 68/20
5,970,554 A 10/1999 Shore et al.
6,189,346 B1 * 2/2001 Chen et al. ..... 68/205 R
6,425,192 B2 7/2002 Arrieta et al.
6,434,803 B1 8/2002 Spong
6,568,545 B2 5/2003 Feder
6,584,633 B2 7/2003 Chute et al.
6,960,282 B2 * 11/2005 Bezama et al. ..... 204/224 R
7,020,983 B2 * 4/2006 Bolduan et al. ..... 34/506
2004/0000068 A1 * 1/2004 Bolduan et al. ..... 34/487

* cited by examiner

FIG. 1
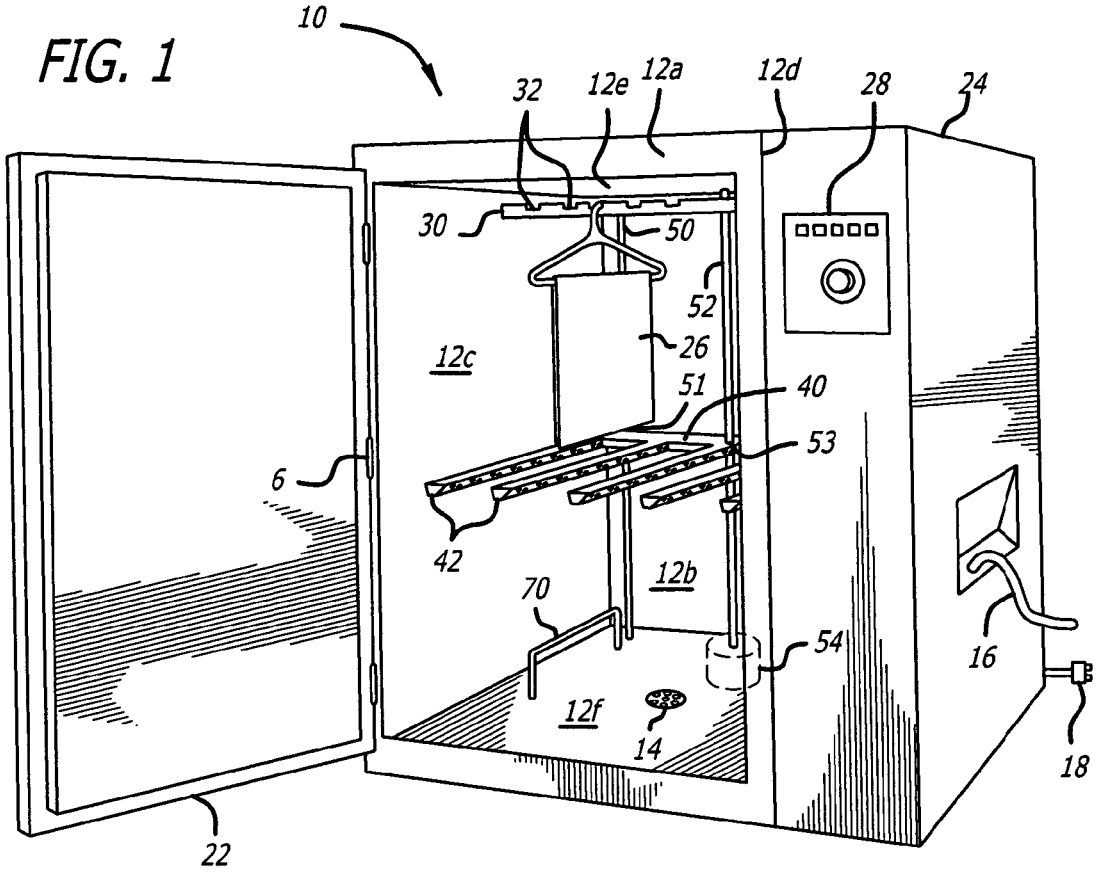
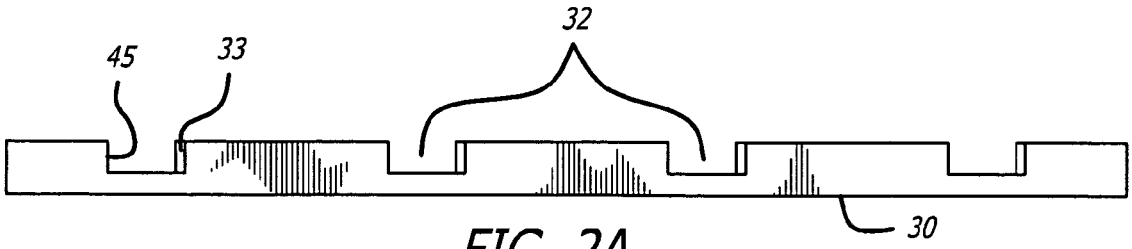
FIG. 2A
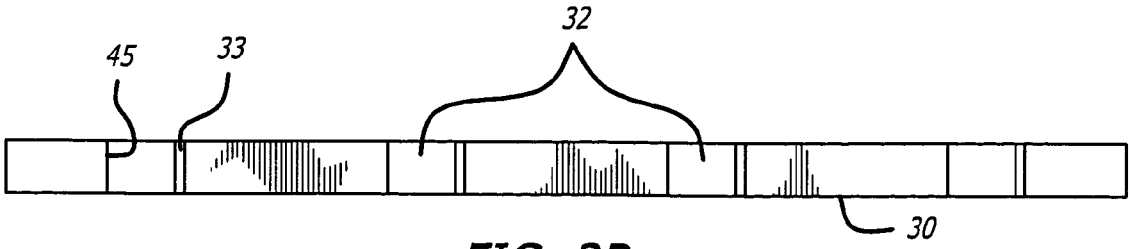
FIG. 2B

APPARATUS FOR PROCESSING GARMENTS INCLUDING A WATER AND AIR SYSTEM

BACKGROUND

A variety of machines in which clothes may be hung and processed in a single unit have been proposed. There are a series of patents that require the use of solvents for dry cleaning garments, for example U.S. Pat. No. 2,845,786, issued to E. L. Chrisman on Aug. 5, 1958; U.S. Pat. No. 3,166,923 issued to Zacks on Jan. 26, 1965; and U.S. Pat. No. 2,741,113, issued to Norkus on Apr. 10, 1056. The use of solvents, especially in the home, can create health and safety issues.

There are additional patents that claim a machine in which the clothes are "finished" only. These patents are directed toward de-wrinkling and smoothing the clothes, typically by using steam. However, these machines do not clean the clothes, these machines are used after the clothes are already clean. Some examples of these devices are seen in U.S. Pat. No. 3,707,855 issued to Buckley on Jan. 2, 1973; U.S. Pat. No. 4,391,602 issued to Stichnoth et al. on Jul. 5, 1983; U.S. Pat. No. 3,739,496 issued to Buckly et al. on Jun. 19, 1973; U.S. Pat. No. 3,732,628 issued to Bleven et al. on May 15, 1973; and U.S. Pat. No. 4,761,305 issued to Ochiai on Aug. 2, 1988. U.S. Pat. No. 6,189,346 issued to Chen et al. on Feb. 20, 2001 discloses a clothes treating apparatus that uses a "conditioning mist" as an alternative to dry-cleaning clothes. This patent does not provide for washing clothes with water or rinsing the clothes.

In addition, some patents claim machines that only dry clothes, and do not wash or finish the clothes: for example U.S. Pat. No. 3,257,739 issued to Wentz on Jun. 28, 1966; and U.S. Pat. No. 3,102,796 issued to Erickson on Sep. 3, 1963.

U.S. Pat. No. 3,114,919 issued to Kenreich on Dec. 24, 1963 discloses a machine that can wash and dry using conventional laundry soap, however, this apparatus can only wash one shirt, or the like, and one pair of pants, or the like, at a time. In addition, this patent discloses an apparatus that has fixed outlets for dispensing wash and rinse water. This patent, like U.S. Pat. No. 3,664,159 issued to Mazza on May 23, 1972, utilizes a shaking of the garments to remove dirt and debris from the garments. However, shaking the garments can cause the garments to fall during the wash cycle, and can impart wrinkles to the garments. In addition, these patents teach that the wash water is applied from the top and bottom of the clothing, and not along the length of the clothing.

Finally, U.S. Pat. No. 3,672,188 issued to Geschka et al. on Jun. 27, 1972 discloses an apparatus that uses conventional laundry soap water, and hot air to wash and dry clothes. However, in this patent the soap and water are applied to the garments from top and bottom nozzles. Likewise, in U.S. Pat. No. 3,868,835 issued to Todd-Reeve on Mar. 4, 1975, the water and soap are applied from nozzles located near the top and bottom of the apparatus. In neither of these apparatuses is the soap and water applied over the entire length of the garments.

SUMMARY

In one aspect of the present invention, a garment processing apparatus includes a manifold having a plurality of arms, each of the arms being configured to discharge air, a cabinet configured to support one or more garments with each of the garments positioned between a different pair of adjacent arms, and a condenser configured to remove water from the air discharged from the manifold.

In another aspect of the present invention, a garment processing apparatus includes an air pump, a manifold coupled to the air pump, the manifold having a plurality of horizontal arms, each of the arms having one or more exits. The garment processing apparatus also includes a cabinet having a hanging bar from which one or more garments may be supported with each of the garments positioned between a different pair of adjacent arms, the cabinet further having an air outlet, and a condenser disposed between the air outlet of the cabinet and the air pump.

In yet another aspect of the present invention, a garment processing apparatus includes means for supporting one or more garments, means for blowing air onto each of the garments from a manifold that traverses the length of the garments at least one time, means for recirculating the air blown onto each of the garments back to the manifold, and means for removing water from the recirculated air.

In a further aspect of the present invention, a garment processing apparatus includes means for supporting one or more garments, means for blowing air onto both sides of each of the garments from a manifold, means for recirculating the air blown onto each of the garments back to the manifold, and means for removing water from the recirculated air.

In yet a further aspect of the present invention, a garment processing apparatus includes a manifold having a plurality of arms, each of the arms being configured to discharge air, a cabinet configured to support one or more garments with each of the garments positioned between a different pair of adjacent arms, and a steam generator configured to inject stream into the air discharged by the manifold.

In another aspect of the present invention, a garment processing apparatus includes a manifold having a plurality of arms, each of the arms being configured to discharge air, a cabinet configured to support one or more garments with each of the garments positioned between a different pair of adjacent arms, a reservoir configured to hold a chemical agent, and a pump configured to inject the chemical agent from the reservoir into the air discharged from the manifold.

In yet another aspect of the present invention, a method of processing garments includes supporting one or more garments in a cabinet, blowing air onto both sides of the garments in the cabinet from a manifold, recirculating the air blown onto each of the garments back to the manifold, and removing water from the recirculated air.

It is understood that other embodiments of the present invention will become readily apparent to those skilled in the art from the following detailed description, wherein various embodiments of the invention are shown and described by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Aspects of the present invention are illustrated by way of example, and not by way of limitation, in the accompanying drawings, wherein:

FIG. 1 is a perspective view of the garment processing apparatus from the front with the door open;

FIG. 2A is an elevation view of a hanger mechanism for use in the garment processing apparatus;

FIG. 2B is a plan view of the hanger mechanism;

DETAILED DESCRIPTION

Figure 2C:
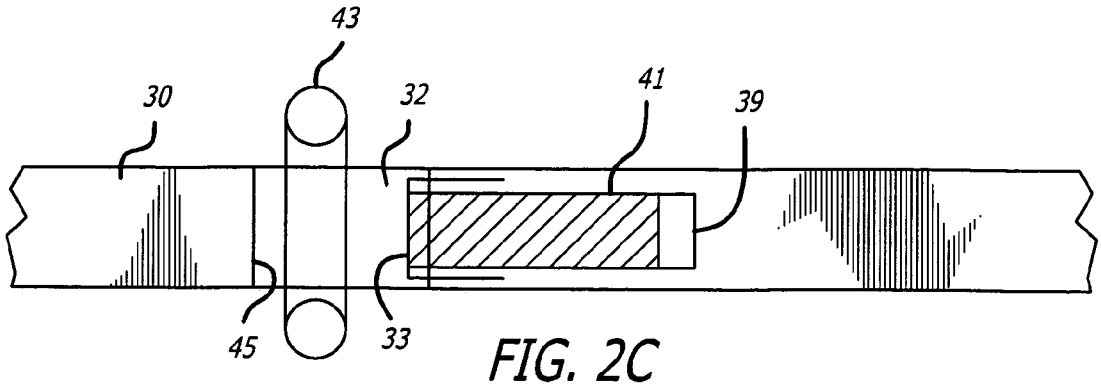
FIG. 2C is a detailed cross-sectional plan view of a variable width notch in the hanger mechanism with the notch in the open position.

The detailed description set forth below in connection with the appended drawings is intended as a description of various embodiments of the present invention and is not intended to represent the only embodiments in which the present invention may be practiced. Each embodiment described in this disclosure is provided merely as an example or illustration of the present invention, and should not necessarily be construed as preferred or advantageous over other embodiments. The detailed description includes specific details for the purpose of providing a thorough understanding of the present invention. However, it will be apparent to those skilled in the art that the present invention may be practiced without these specific details. In some instances, well-known structures and components are shown in block diagram form in order to avoid obscuring the concepts of the present invention.

In one embodiment, a single apparatus may be used to process garments. The term "process" garments means to wash, rinse, dry and/or steam garments. The apparatus may be used in residences or in hotel rooms, hospitals, Laundromats, and other commercial applications. In a conventional washing machine it is best to transfer the clothes soon after they are washed to the dryer in order to prevent wrinkling. In addition, it is even better to rapidly remove dried clothes from the dryer shortly after completion of the drying process to further prevent wrinkling. When using the apparatus described herein, there is no need to rapidly move clothes from the washing machine to the dryer, or to rapidly remove clothes from the dryer. The clothes are washed and dried on hangers in the apparatus. Once the cycle is complete, the clothes may remain in the apparatus indefinitely, until ready to be worn, suspended from hangers.

The apparatus may be used by placing garments on hangers, and hanging the garments on a bar within the apparatus. Plastic hangers, or any other hanger that will support the garments without imparting stains to the wet garments, may be used. A hanger alignment mechanism may also be used to secure the garments in a relatively fixed position during the operating cycle.

A manifold may be used to supply water, steam and/or air to the garments. Chemical agents for treating the garments may be injected into the water, steam and/or air stream in the manifold. The manifold may include a series of arms. A respective pair of the series of arms is disposed on each side of a garment suspended therebetween. Each pair of arms contains nozzles, configured to direct fluids, such as water, steam, and/or air stream, at a downward angle on both sides of the garment disposed therebetween. The manifold, arms, and nozzles may contain a dual internal system of pipes. One set of internal pipes allows wash water and/or rinse water to be directed toward the garments. The other set of internal pipes allows air and/or steam to be directed toward the garments.

During operation, the wash water containing one or more chemical agents such as soap and the like may travel up the first set of internal pipes in the manifold, through the arms, out the nozzles, and onto the clothes. The entire manifold may be configured to traverse up and down the length of the hanging clothes, spraying the clothes with soapy water.

After the wash cycle is complete, rinse water may travel through the same first set of internal pipes in the manifold, and arms, and out the same nozzle. The manifold may again traverse up and down the length of the hanging clothes, spraying the clothes with rinse water.

In the drying cycle, air and/or steam may travel through the second set of internal pipes in the manifold, through the arms, and out a separate set of nozzles and toward the garments. The air may be used to dry the garments and the steam may be used to remove the wrinkles from the garments. Chemical agents may be injected into the steam and/or air stream. The steam, and more particularly, the air may be re-circulated through a condenser. The condenser may be used to remove the moisture from the steam and/or air stream.

The sequence and duration of the wash cycle, rinse cycle, drying cycle and steam cycle may be controlled through a control panel.

When the washing and drying cycle is complete, the clothes may remain in the apparatus until such time as is convenient to remove the clothes.

Referring to FIG. 1, an apparatus 10 may include a cabinet 12 with a front wall 12*a*, a rear wall 12*b*, two side walls 12*c* and 12*d*, and a top and bottom wall 12*e* and 12*f* respectively. The bottom wall 12*f* may include a drain 14. In one embodiment of the apparatus 10, the walls of cabinet 12 are insulated. The apparatus 10 may be connected to a water supply by a hose 16 and an electrical supply by conductors 18.

The cabinet 12, which may be sealed against the escape of water, may be provided with a door 22 through which clothing to be processed can be inserted. In one embodiment of the apparatus, the door 22 may be transparent so that the garments may be viewed during the operating cycle. Alternatively, the door 22 may be opaque and insulated. The door 22 may be attached to the cabinet 12 with one or more conventional hinges 6. The door 22 may be closed and watertight during operation of the apparatus. The door 22 may, but does not have to, extend the entire length of the front wall 12*a* of the cabinet 12.

The cabinet 12 may be adjacent to a sub-cabinet 24. The sub-cabinet 24 may include the mechanism by means of which the operating cycle of the apparatus 10 is automatically carried out. The operating cycle may include any variation or combination of pre-washing, washing, rinsing, steaming and drying. For means of illustration only, and not as a limitation, the control mechanism may allow the consumer to set the apparatus for heavy or light washing; set the water temperature; add chemical agents such as bleach, fabric softeners, or other laundry additives, set one or more rinse cycles; set an initial delay of the start of the wash cycle to allow for the action of spot-removers; set a delay of the start of the wash cycle to accommodate the convenience of the user; set a pre-wash cycle; set varying drying temperatures and times, set a steam cycle after drying to remove wrinkles from the garments, and set the apparatus for steam cycle only to quickly remove wrinkles from garments that do not require washing. The various washing and drying requirements may be set via a control panel 28. The electricity for running the control panel 28, and all other parts of the apparatus 10, may be supplied through the conductor 18.

The control panel 28 may be used to effectuate the different washing and drying needs of the user. The control panel 28 may include a timer, a means for setting or programming the various washing, rinse, drying and steam cycles, as well as the temperature for each, a means for dispensing chemical agents such as laundry detergent, bleach, fabric softener, or other laundry additives, and a means for regulating the washing, rinsing, steaming and dying times.

The clothes-receiving portion of the cabinet 12 may have, at its upper end, a hanging bar 30. The hanging bar 30 may be suspended horizontally and parallel to the walls 12*a* and 12*b*. The hanging bar 30 may have one or more hanger notches 32. Hanger-mounted garments 26 such as clothes, towels, sheets or other items to be laundered may be placed on a conventional, non-rusting, hanger. The hanger may be inserted onto the hanging bar 30, and held at regularly spaced intervals by the notches 32 in the hanger bar.

Figure 2D:
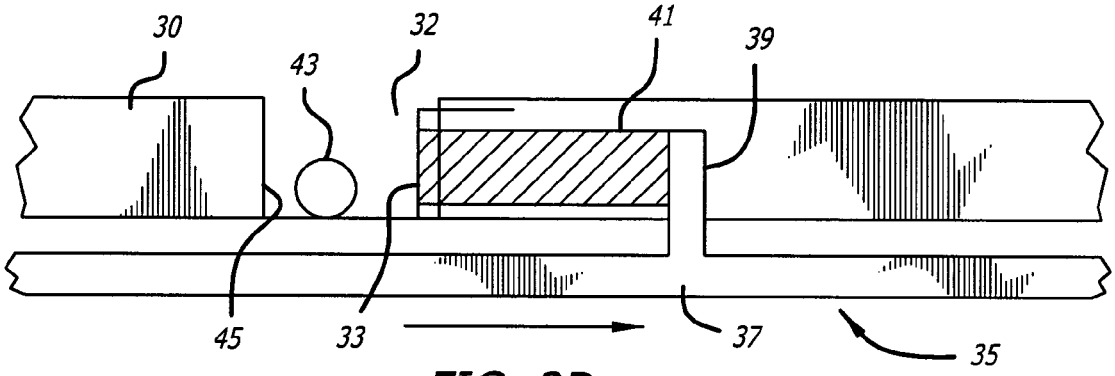
FIG. 2D is a detailed cross-sectional elevation view of the variable width notch in the hanger mechanism with the notch in the open position.
Figure 2E:
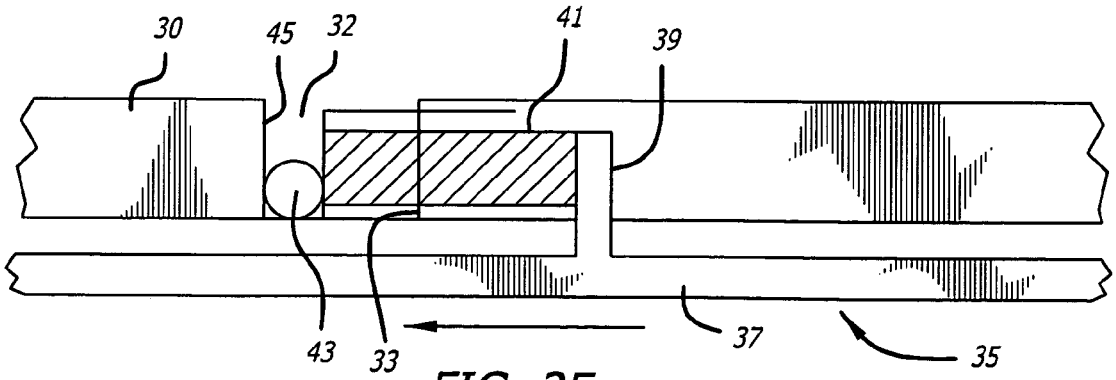
FIG. 2E is a detailed cross-sectional elevation view of the variable width notch in the hanger mechanism with the notch in the closed position.

Referring to FIGS. 2A-2E, the hanger bar 30 may be configured with variable width hanger notches 32 that automatically adjust to the hanger width to align the hangers in a parallel manner. The variable width notch 32 may include a sliding notch wall 33. An actuator 35, or other similar device, may be used to control the width of the notch 32 by moving the sliding notch wall 33 in and out of the notch 32. In one embodiment, the actuator 35 may include an elongated horizontal member 37 that extends the length of the hanger bar 30. The elongated horizontal member 37 may include a number of spaced apart vertical members 39, one vertical member for each variable width notch. As shown in FIGS. 2C-2E, the vertical member 39 may be coupled to the sliding notch wall 33 of its respective variable width notch 32 with a spring 41.

The elongated horizontal member 35 may be moved between an open and closed position by a solenoid (not shown) or other actuating device. FIGS. 2C and 2D show the elongated horizontal member 35 in the open position with the notch 32 in its widest position. In the open position, a hanger 43 may be placed in the notch 32, or alternatively, removed from the notch 32. With the hanger 43 in the notch 32, the actuator 35 may be used to adjust the variable width notch 32 to secure the hanger 43. This may be achieved by moving the elongated horizontal member 37 into the closed position as shown in FIG. 2E. As the elongated horizontal member 37 is moved into the closed position, the vertical member 39 moves the sliding notch wall 33 inward until it engages the hanger 43 and forces it against the opposite fixed wall 45 of the notch. With the hanger 43 lodged between both the sliding side 33 and the fixed wall 45 of the notch 32, the spring 41 will begin to compress as the actuator 35 continues to move towards the closed position. This approach allows different diameter hangers to be used in the apparatus. The variable width notch 32 will automatically adjust to the width of the hanger when the elongated horizontal member 37 of the actuator 35 is forced into the closed position.

As indicated above, the elongated horizontal member 37 of the actuator 35 may be moved between the open and closed position by a solenoid (not shown) or other actuating device. In one embodiment of the hanger bar 30, the solenoid may be user controlled by a switch (not shown). With this approach, the user can simply place the switch in one position to access the hangers and another position to secure the hangers in place for operation. Alternatively, the solenoid may be controlled automatically. By way of example, a switch (not shown) responsive to the position of the door 22 (see FIG. 1) may be used. In this configuration, the notches may be opened into their widest position when the door is opened to release the hangers. When the door is closed, the variable width hanger notch may adjust to the hanger width causing parallel alignment of the hangers during operation.

Referring to FIGS. 1 and 3A-3C, a manifold 40 may be used to supply water, steam and/or air to the clothes. The manifold 40 may include a plurality of arms 42. The arms 42 may be in a single plane, parallel to each other, and perpendicular to the hanging bar 30. The arms 42 may extend on each side of the hanger-mounted garments 26. The first arm in the parallel plane is 42*a*, and the last arm in the parallel plane is 42*z*. The arms 42 are configured such that a hanger-mounted garment 26 may be disposed between and proximate to a pair of the arms 42. For example, a pair of the arms 42 are arms 42*a* and 42*b*.

Figure 3A:
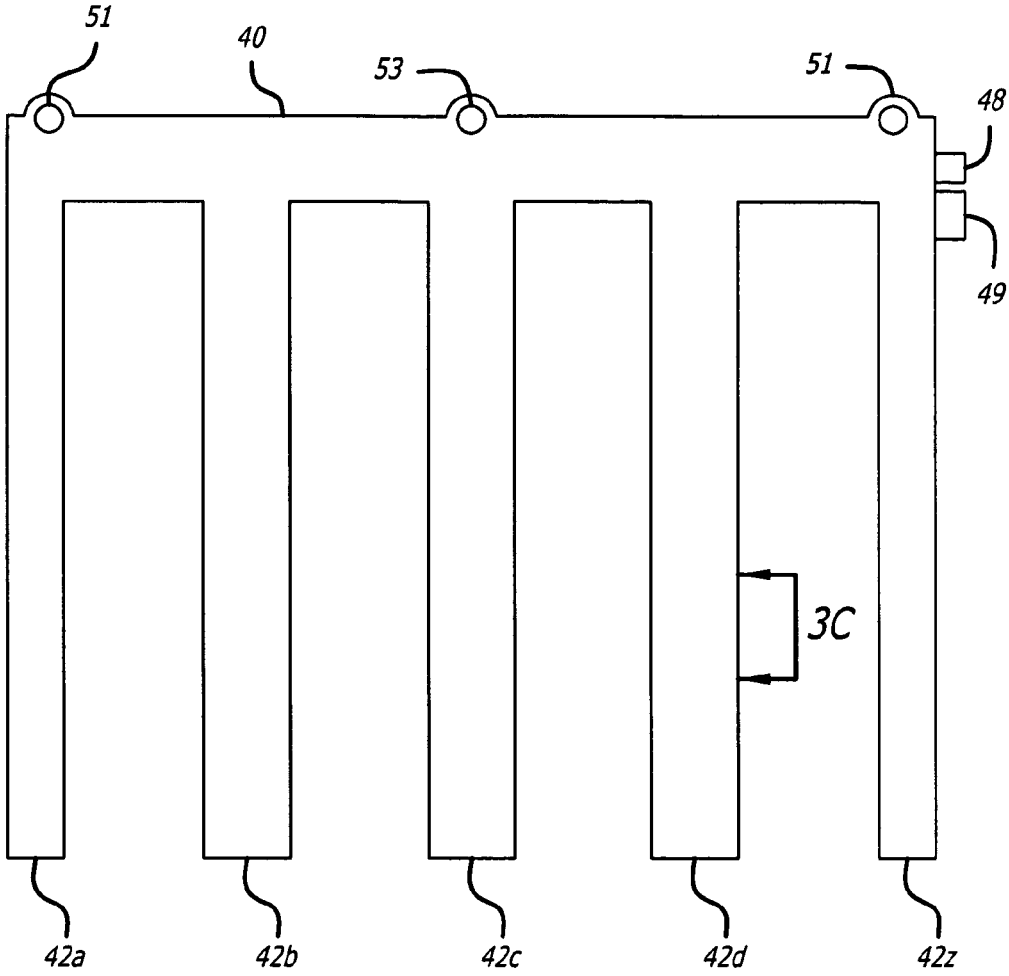
FIG. 3A is a plan view of the manifold.
Figure 3B:
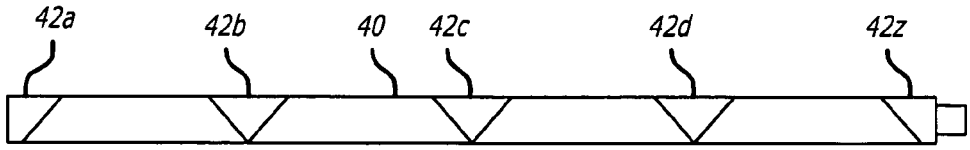
FIG. 3B is a front elevation view of the manifold of FIG. 3A.
Figure 3C:
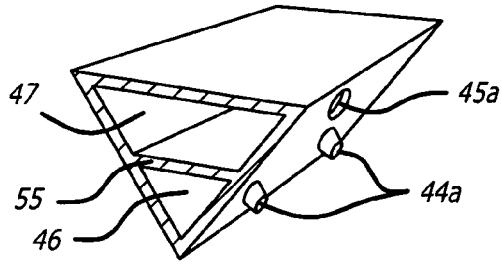
FIG. 3C shows a partial sectional view of the area indicated in FIG. 3A.

The manifold 40 may have two sets of internal pipes. One set is the liquid-carrying pipes 46, which may be used to transport wash and rinse water. The other set is the air-carrying pipes 47, which may be used to transport air and steam. The liquid-carrying pipes 46 and air carrying pipes 47 may be a separate set of internal pipes inside manifold 40. Alternatively, as shown in FIG. 3C, the manifold 40, liquid-carrying pipes 46, and air carrying pipes 47 may be manufactured as a single unit with a divider 55 separating the air in the air-carrying pipes 47 from the water in the water-carrying pipes 46.

Figure 4:
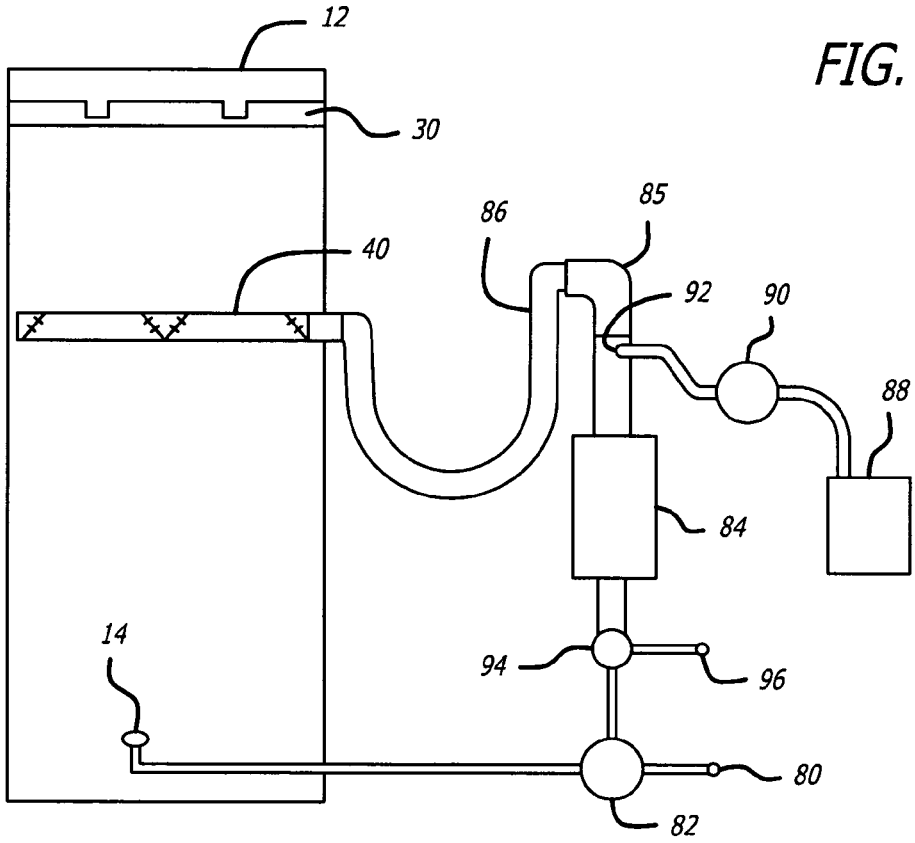
FIG. 4 is a functional block diagram illustrating a water system in the garment processing apparatus.

FIG. 4 is a functional block diagram illustrating a water system, which may be used during the wash and rinse cycles. In the water system, water may enter the sub-cabinet 24 through a water inlet 80 attached to the water supply hose 16. A water pump 82 may be configured to pump either return water from the drain 14 or fresh water from the water supply hose 80, through a heater 84 to the manifold 40. A flexible pipe 86 may be used to connect a rigid pipe 85 extending from the heater 84 to the manifold 40.

A reservoir 88 may be provided for laundry detergent or other chemical agents that may be injected into the water stream, as requested by the user. A peristaltic pump 90, or any other suitable pump, may be used to draw the chemical agents from the reservoir 88 and inject them into the water stream through a nozzle 92 penetrating the rigid pipe 85. The peristaltic pump 90 may be disabled during the rinse cycle.

In either case, once the water (with or without chemical agents) reaches the manifold 40, it may exit the arms 42 through liquid-exits 44. The liquid-exits 44 are configured such that individual hanger mounted garments 26 disposed adjacent thereto may be sprayed on both sides with the water/detergent mixture. The manifold 40 may move up and down the length of the hanger-mounted garments 26 spraying both sides of garments 26 with the water. For example, as illustrated in FIG. 1, the manifold 40 may be vertically positioned to receive a hanger-mounted garment 26 between two adjacent arms 42. The liquid-exits 44 of the two adjacent arms 42 facing the hanger-mounted garment 26 may be used to spray both sides of the hanger-mounted garment 26. The water may run off the garments 26, down to the bottom wall 12f, through the drain 14, and back to the water pump 82. A waste water valve 94 may be used to recirculate the water, or discharge the water through a water outlet pipe 96.

Figure 5:
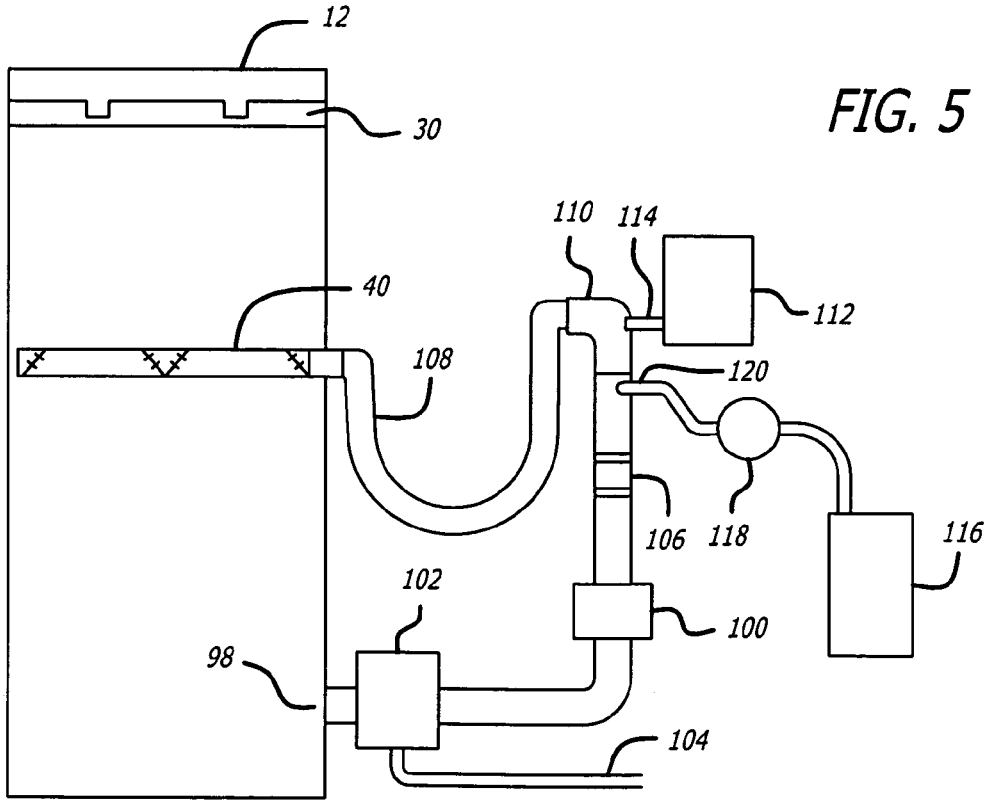
FIG. 5 is a functional block diagram illustrating a closed-loop air system in the garment processing apparatus.

FIG. 5 is a functional block diagram illustrating a closed-loop air system, which may be used during the drying and steam cycle. In the air system, air may be drawn from the cabinet 12 through an air intake port 98 by a blower 100. The blower 100 may be a variable speed or fixed speed blower. A condenser 102 may be inserted in-line between the air intake port 98 and the blower 100. The condenser 102 may be used to remove water from the air drawn from the cabinet 12. The condensed water may be discharged through a water ejection tube 104. The water ejection tube 104 may be connected to the water outlet pipe 96 in the water system.

The blower 100 may be used to force the air drawn from the cabinet 12 through a heater 106 and into the manifold 40. A flexible pipe 108 may be used to connect a rigid pipe 110 extending from the heater 106 to the manifold 40. The rigid pipe 110 may provide a suitable location for injecting various elements into the air stream. By way of example, a steam generator 112 may be used to inject steam into the air stream through a nozzle 114 penetrating the rigid pipe 110. A reservoir 116 may also be used as a container for chemical agents that may be injected into the air stream. A peristaltic pump 118, or any other suitable pump, may be used to draw the chemical agents from the reservoir 116 and inject them into the air stream through a nozzle 120 also penetrating the rigid pipe 110.

Once the air stream reaches the manifold 40, it may be directed to the hanger-mounted garments 26 through the arms 42. The manifold 40 may move up and down the length of the hanger-mounted garments 26 blowing air or steam on both sides of garments 26.

Returning to FIGS. 3A-3C, each arm 42 of the manifold 40 may include a plurality of liquid-exits 44 and air-exits 45. The liquid-exits 44 and the air-exits 45 may be either nozzles or holes. Arm 42*a* may include a plurality of exits 44*a* and 45*a* on only the side facing toward the garment 26, and arm 42*z* may include has a plurality of exits 44*z* and 45*z* on only the side facing toward garment 26. The remainder of the arms 42 may have a plurality of exits 44 and 45 on both sides of each arm 42 so that the hanger-mounted garments 26 may be sprayed from both sides.

The liquid-exits 44 and air-exits 45 may be placed on the arms 42 so that the liquid or air exits the arms 42 in a downward direction. The shape of the arms may be any shape that allows the liquid-exits 44 and air-exits 45 to point downward. By way of example, the arms 42 may have a cross-sectional shape of an isosceles triangle with the two equal sides of the triangle facing downward, and with the liquid-exits 44 and air-exits 45 on the two downward facing sides of the triangle. The downward angle of the liquid or air may be any angle necessary to prevent the garments 26 from tangling and twisting, and to help smooth the garments 26. By way of example, a downward angle between 40 degrees and 60 degrees may be used on the liquid-exits 44 and the air-exits 45.

There are no specific requirements regarding placement of the liquid-exits 44 and air exits 45 relative to each other. That is, the liquid-exits 44 and the air-exits 45 may be placed in a horizontal line, may be placed with either on top of the other, or may be placed in any arrangement that allows liquid to exit the liquid-exits 44, and allows air to exit air-exits 45.

Returning to FIG. 1, the manifold 40 may have one or more unthreaded guide holes 51. The apparatus 10 may contain one or more guide post 50. In one embodiment of the apparatus 10, the number of unthreaded guide holes 51 is equal to the number to guide posts 50. The guide post 50 may be a smooth post that runs in a vertical direction parallel to the rear wall 12*b*. The guide post 50 may be inserted through the unthreaded hole 51 in the manifold 40, and the manifold 40 may freely move along the length of the guide post 50.

The manifold 40 may have one or more threaded screw holes 53. The apparatus 10 may contain one or more screw posts 52. In one embodiment of the apparatus 10, the number of threaded screw holes 53 is equal to the number of the screw posts 52. The screw post 52 may be a threaded post that runs in a vertical direction parallel to the rear wall 12*b*. The screw post 52 and the threaded screw hole 53 may be threaded so that the threaded screw post 52 will turn inside the threaded screw hole 53 and, in turning, move the manifold 40 either up or down.

The screw post 52 may be moveably attached to a motor 54. The motor 54 may be used to turn the screw post 52 in an alternating clockwise and counter-clockwise direction, thereby moving the manifold 40 up and down the screw post 52. The motor 54 may be programmed via the control panel 28 so that the screw post 52 turns in one direction for varying lengths of time. The length of time that the screw post 52 turns in any one direction may be directly correlated to the length that the manifold 40 travels in any one direction. Thus, the screw post 52 may turn for such a length of time that the manifold 40 travels only part of the height of the cabinet 12, or the entire length of the cabinet 12. The control panel 28 may also provide a means for setting or programming the speed of the upward/downward motion, as well as the distance the manifold 40 travels in the upward/downward plane.

In one embodiment of the apparatus, one or more racks 70 may be attached to the bottom wall 12*f*. The rack 70 may extend horizontally near the bottom of the cabinet 12. Socks or other small items may be placed on the rack 70 and treated as described above.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method of processing garments, comprising:

supporting one or more garments in a stationary position in a cabinet;

blowing air onto both sides of the at least one of the garments in the cabinet from a manifold having a plurality of arms configured to discharge air;

translating the manifold vertically to traverse the vertical length of the garments at least one time while blowing the air onto the garments;

recirculating the air blown onto each of the garments back to the manifold; and removing water from the recirculated air.

2. The method of claim 1 further comprising heating air recirculated.

3. The method of claim 1 further comprising injecting steam into the air blown onto the garments.

4. The method of claim 1 further comprising injecting a chemical agent into the air blown onto the garments.

5. A garment processing apparatus, comprising:

a manifold having a plurality of arms, each of the arms being configured to discharge air;

a cabinet configured to enclose the plurality of arms, the cabinet capable of supporting one or more garments suspended therein; and a condenser configured to remove water from the air discharged from the manifold, wherein at least some of the plurality of arms form at least one pair of adjacent arms, the at least one pair of adjacent arms being configured to receive a garment suspended vertically therebetween, the one or more pairs of adjacent arms being configured to extend horizontally across the garment suspended therebetween to allow the air to be discharged toward both sides of the garment disposed proximate thereto wherein the manifold is further configured to traverse, by vertical translation, the length of the garment at least one time while discharging the air.

6. The garment processing apparatus of claim 5 wherein the at least one pair of adjacent arms is configured to discharge the air in a downward direction toward the garment suspended therebetween.

7. The garment processing apparatus of claim 5 further comprising an air pump configured to draw the air discharged from the manifold into the condenser.

8. The garment processing apparatus of claim 7 further comprising a reservoir configured to hold a chemical agent, and a second pump configured to inject the chemical agent from the reservoir into the air provided by the condenser to the manifold.

9. The garment processing apparatus of claim 8 wherein the manifold is further configured to traverse the length of the one or more garments at least one time while discharging the air with the chemical agent.

10. The garment processing apparatus of claim 7 further comprising a pipe configured to couple air from the condenser to the manifold.

11. The garment processing apparatus of claim 10 further comprising a steam generator configured to inject steam into the air provided by the condenser to the manifold.

12. The garment processing apparatus of claim 11 wherein the manifold is further configured to traverse the length of the one or more garments at least one time while discharging the air with the steam.

13. The garment processing apparatus of claim 11 wherein the steam generator is further configured to inject steam into the air provided by the blower to the manifold a portion of the time, and wherein the manifold is further configured to traverse the length of the one or more garments at least one time while discharging the air without the steam, and traverse the length of the one or more garments at least one more time while discharging the air with the steam.

14. The garment processing apparatus of claim 10 further comprising a heater configured to heat the air coupled from the condenser to the manifold.

15. A garment processing apparatus, comprising:

an air pump;

a cabinet having a stationary hanging bar from which one or more garments may be vertically supported, the cabinet further having an air outlet;

a condenser disposed between the air outlet of the cabinet and the air pump; and, a manifold coupled to the air pump, the manifold having a plurality of horizontal arms, each of the arms having one or more exits, at least two adjacent arms of the plurality of horizontal arms forming a pair of arms, the pair of arms being configured to receive one of the garments vertically disposed therebetween, the pair of arms being configured to discharge air toward both sides of the one garment through one or more exits disposed adjacent the one garment wherein the manifold is movable by translation in the vertical direction.

16. The garment processing apparatus of claim 15 further comprising an air pump configured to draw the air discharged from the manifold into the condenser.

17. The garment processing apparatus of claim 15 further comprising a pipe coupling the manifold to the air pump, and a steam generator configured to inject steam into the pipe.

18. The garment processing apparatus of claim 15 wherein the stationary hanging bar includes a notch configured to receive a hanger.

19. The garment processing apparatus of claim 15 further comprising a pipe coupling the manifold to the air pump, a reservoir, and a second pump configured to draw a chemical agent from the reservoir and inject the chemical agent into the pipe.

20. The garment processing apparatus of claim 19 further comprising a steam generator configured to inject steam into the manifold.

21. The garment processing apparatus of claim 15 further comprising a heater disposed between the condenser and the manifold.

22. A garment processing apparatus, comprising:

means for providing stationary support for one or more garments in a cabinet;

means for blowing air onto both sides of at least one of the garments in the cabinet using a manifold that traverses by vertical translation of the manifold the vertical length of the garments at least one time;

means for recirculating the air blown onto each of the garments back to the manifold; and means for removing water from the recirculated air.

23. A garment processing apparatus, comprising:

an air source;

a manifold coupled to the air source, the manifold having a plurality of horizontal arms, each of the arms having one or more exits;

a cabinet having a fixed hanging bar configured to support one or more garments, at least two adjacent arms of the plurality of horizontal arms forming a pair of arms, the pair of arms being configured to receive one of the garments vertically disposed therebetween, the pair of arms being configured to discharge air toward both sides of the one garment through the one or more exits disposed adjacent the one garment wherein the manifold is movable by translation in the vertical direction; and a steam generator configured to inject stream into the air discharged by the manifold wherein the manifold is further configured to traverse by vertical translation of the manifold the length of the one or more garments at least one time while discharging the air and steam.

24. A garment processing apparatus, comprising:

an air source;

a manifold coupled to the air source, the manifold having a plurality of arms, each of the arms having one or more exits;

a cabinet having a fixed hanging bar configured to support one or more garments, at least two adjacent arms of the plurality of horizontal arms forming a pair of arms, the pair of arms being configured to receive one of the garments vertically disposed therebetween, the pair of arms being configured to discharge air toward both sides of the one garment through the one or more exits disposed adjacent the one garment wherein the manifold is movable by translation in the vertical direction;

a reservoir configured to hold a chemical agent; and a pump configured to inject the chemical agent from the reservoir into the air discharged from the manifold wherein the manifold is further configured to traverse by vertical translation of the manifold the length of the one or more garments at least one time while discharging the air.

25. A garment processing apparatus, comprising:

a fluid source;

a manifold coupled to the fluid source, the manifold having a plurality of arms, each of the arms having one or more exits;

a cabinet having a hanging bar configured to support one or more garments in a fixed position, at least two adjacent arms of the plurality of horizontal arms forming a pair of arms, the pair of arms being configured to receive one of the garments vertically disposed therebetween, the pair of arms being configured to spray both sides of the one garment with the fluid through the one or more exits disposed adjacent the one garment wherein the manifold is movable by translation in the vertical direction;

a reservoir configured to hold a chemical agent; and a pump configured to inject the chemical agent from the reservoir into the fluid discharged from the manifold wherein the manifold is further configured to traverse by vertical translation of the manifold the length of the one or more garments at least one time while discharging the fluid.

26. An apparatus, comprising:

a manifold having a plurality of arms, each of the arms being configured to discharge air, the plurality of arms comprising a pair of adjacent arms about parallel, the pair of adjacent arms being configured to receive a garment suspended vertically therebetween, configured to extend horizontally across the garment suspended vertically therebetween, and configured to discharge the air toward both sides of the garment suspended vertically therebetween, the manifold configured to traverse by vertical translation the length of the garment suspended vertically between the pair of adjacent arms, one or more times while discharging the air;

a cabinet configured to enclose the plurality of arms, the cabinet capable of supporting the garment suspended vertically between the pair of adjacent arms; and a condenser configured to remove water from the air discharged from the manifold.

* * * * *